United States Patent [19]

Dunham

[11] Patent Number: 4,974,831

[45] Date of Patent: Dec. 4, 1990

[54] EXERCISE TREADMILL

[75] Inventor: Paul T. Dunham, Everett, Wash.

[73] Assignee: Precor Incorporated, Bothell, Wash.

[21] Appl. No.: 468,100

[22] Filed: Jan. 10, 1990

[51] Int. Cl.[5] ..... A63B 23/06

[52] U.S. Cl. ..... 272/69; 272/130

[58] Field of Search ..... 272/69, 70, 130, 97; 254/93 R; D21/192; 198/841, 842, 843

[56] References Cited

U.S. PATENT DOCUMENTS

| | | | |
|---|---|---|---|
| 931,394 | 8/1909 | Day . | |
| 2,117,957 | 5/1938 | Heller | 272/69 |
| 2,399,915 | 5/1946 | Drake | 272/69 |
| 3,501,140 | 3/1970 | Eichorn | 272/58 |
| 3,627,313 | 12/1971 | Schonfeld | 272/57 |
| 3,628,654 | 12/1971 | Haracz | 198/179 |
| 3,643,943 | 2/1972 | Erwin, Jr. et al. | 272/69 |
| 3,689,066 | 9/1972 | Hagen | 272/69 |
| 3,948,351 | 4/1976 | Baumann | 182/139 |
| 4,151,988 | 5/1979 | Nabinger | 272/69 |
| 4,350,336 | 9/1982 | Hanford | 272/69 |
| 4,363,480 | 12/1982 | Fisher et al. | 272/69 |
| 4,374,587 | 2/1983 | Ogden | 272/69 |
| 4,445,683 | 5/1984 | Ogden | 272/69 |
| 4,591,147 | 5/1986 | Smith et al. | 272/69 |
| 4,602,779 | 7/1986 | Ogden | 272/69 |
| 4,643,418 | 2/1987 | Bart | 272/69 |
| 4,645,197 | 2/1987 | McFee | 272/65 |
| 4,664,371 | 5/1987 | Viander | 272/69 |
| 4,664,646 | 5/1987 | Rorabaugh | 474/88 |

FOREIGN PATENT DOCUMENTS

| | | | |
|---|---|---|---|
| 644774 | 7/1962 | Canada . | |
| 3601184 | 1/1986 | Fed. Rep. of Germany . | |
| WO81/01960 | 7/1981 | Japan . | |
| 546523 | 3/1977 | U.S.S.R. . | |
| 1297879 | 3/1987 | U.S.S.R. . | |
| 2152825A | 8/1985 | United Kingdom . | |
| 2212729 | 8/1989 | United Kingdom | 272/69 |

*Primary Examiner*—Stephen R. Crow

*Attorney, Agent, or Firm*—Christensen, O'Connor, Johnson & Kindness

[57] ABSTRACT

An exercise treadmill (10) includes a deck assemlby (12) having a rearward end portion pivotally mounted on an underlying frame (14). A powered endless belt (100) is mounted on the deck assembly (12) to present a moving surface which slides over the top of the deck assembly. The forward end of the deck assembly is supported by a suspension system (20) utilizing lever arms (160L and 160R) mounted on the frame (14) to pivot about an axis (169). The lever arms are pivotally interconnected with the deck at a location distal from the pivot axis of the lever arms. Dampeners in the form of shock absorbers (178) are connected between the lever arms and the frame to impart a progressively increasing damping force on the lever arms as the lever arms rotate about their pivot axis under the influence of the descending deck.

57 Claims, 6 Drawing Sheets

EXERCISE TREADMILL

TECHNICAL FIELD

The present invention relates to exercise equipment, and more particularly to an exercise treadmill designed to reduce the shock forces imposed on the runner's feet, ankles and legs and also designed to conveniently vary the angle of inclination of the treadmill.

BACKGROUND OF THE INVENTION

Exercise treadmills are now widely used in gymnasiums, spas, clinics and private homes for aerobic exercise, physical examinations and physical therapy, for instance, during recovery from a cardiac illness. An exercise treadmill in its simplest form includes an endless belt that moves over an underlying support composed of a series of rollers or a flat bed. The belt is powered either by the walker's or runner's feet, or by an electric motor. Not uncommonly, exercise treadmills now employ microcomputers that control the speed of the drive motor, monitor and individual's workout, and display various workout parameters, such as time, speed, distance traveled, and calories expanded.

An advancement which has been made to render exercise treadmills more versatile is to position the treadmill at various angles of inclination to simulate walking or running up a grade or down a grade. Various mechanisms have been employed to raise and lower the front end of an exercise treadmill relative to the floor or other support surface on which the treadmill is positioned. Systems for manually changing the inclination of the treadmill are disclosed by U.S. Pat. Nos. 931,394, 2,117,957, 4,151,988, 4,591,147 (assigned to the assignee of the present application), Nos. 4,602,799 and 4,664,371. Powered or motorized systems for adjusting the inclination of treadmills are disclosed by U.S. Pat. Nos. 3,643,943, 4,363,480, 4,643,418; West German Pat. No. 3,601,184 and United Kingdom Pat. No. 2,152,825.

A serious problem associated with running or jogging stems from the shock forces that are imparted on the feet, ankles and knees of the runner upon impact of the runner's feet on the track, pavement, treadmill deck or other unyielding surface. This problem has been addressed in a few prior art treadmill designs. For example, U.S. Pat. No. 2,399,915 discloses an exercise treadmill having an endless belt trained around a forward drive drum and a rear idler drum, both mounted on the ground engaging frame of the treadmill. The drive drum is connected to an electric motor. The belt is supported by a series of underlying transverse rollers mounted on a platform. The ends of the roller platform are supported by shock absorbers which allow the platform to yield under the loads imposed by the runner's feet.

U.S. Pat. No. 4,350,336 discloses motorized exercise treadmill having an underlying frame structure for supporting an endless belt trained over a forward drive roller and a rear idler roller, both mounted on the underlying frame. The upper run of the endless belt is supported by a platform composed of individual rails pivotally connected at their rear ends to the underlying frame. The forward ends of the rails are supported by rubber blocks which can be moved along the length of the rails.

U.S. Pat. No. 3,689,066 discloses a third type of shock absorbing treadmill wherein an endless belt is trained over a drive drum and idler drum both mounted on an underlying frame structure. The upper run of the endless belt is supported by a number of bellows cells mounted on an underlying ridged base plate.

The foregoing attempts to reduce the shock forces imposed on the runner utilizing the treadmill suffer from serious drawbacks. For instance, in each instance the structure for supporting the upper run of the belt is mounted in the resilient manner, but the endless belt itself is not. Rather, the drive roller and idler rollers at the ends of the endless belt are both mounted directly on the underlying frame. As a result, the belt must run over the belt support structure with sufficient slack to allow the underlying support structure to move downwardly in response to the impact of the runner's foot. This slack can cause the belt to present an uneven lateral surface for succeeding foot landings, perhaps leading to twisted ankles and knees or other injuries.

In addition, the level of resistance imparted by the belt support systems disclosed in the foregoing patent references is substantially constant throughout the downward movement or deflection of the belt support structure. The reaction force imposed on the runner, though less than if the belt were not supported by a resilient system, remains very significant. Thus, a substantial level of shock is still transmitted through the feet, ankles and legs of the runner.

SUMMARY OF THE INVENTION

The foregoing drawbacks of known exercise equipment and, in particular, exercise treadmills, are addressed by the present invention which provides a frame, a support platform pivotally mounted on the frame about a first pivot axis and a suspension system for supporting the support platform relative to the frame and permitting the support platform to displace relative to the frame about the first pivot axis between a nominal position and a displaced position under loads imparted on the support platform during use of the apparatus. The suspension system includes at least one lever arm pivotally mounted on either the frame or the support platform to pivot about a second pivot axis between a nominal orientation and a displaced orientation. The lever arm, at a location spaced from the second pivot axis, is pivotally connected to the other of the frame or support platform. The suspension system also includes a first resistance unit for applying a force on the lever arm to resist the rotational movement of the lever arm in a first rotational direction about the second pivot axis, corresponding to the rotation of the lever arm from its nominal orientation to its displaced orientation. The magnitude of the resisting force applied to the lever arm is dependent upon the angular orientation of the rotating lever arm.

In a more specific aspect of the present invention, the first resistance unit is adapted to dampen the rotational movement of the lever arm in the first rotational direction about the second pivot axis.

In a further aspect, the present invention includes connecting the first resistance unit to the lever arm at a location spaced from the second pivot axis. Thus, as the lever arm pivots in its first rotational direction about the second pivot axis, the effective distance separating the line of action of the first resistance unit from the second pivot axis increases. This results in an increase in the mechanical advantage of the first resistance unit on the lever arm. As a result, the magnitude of the resistance force applied to the lever arm is increased.

In another aspect of the present invention, a second resistance unit is utilized to apply a force on the lever arm to resist the rotational movement of the lever arm in the first rotational direction about the second pivot axis and to apply a biasing force on the lever arm when the lever arm is an orientation displaced from its nominal orientation. As such, the second resistance unit serves to rotate the lever arm about the second pivot axis in the direction opposite to the first rotational direction of the lever arm. In a more detailed aspect of the present invention, the magnitude of the force applied by the second resistance unit on the lever arm by selected adjusted.

In a further aspect, the present invention is in the form of an exercise treadmill, wherein the support platform includes a deck, an endless belt presenting a moving surface over the top of the deck, and a drive roller assembly mounted in association with the deck for driving the endless belt. The drive roller assembly includes a rotationally powered axle and a drive roller mounted on the axle in driving engagement with the endless belt. The drive roller includes a hub having a tapered center bore, with the axle being tapered to match the taper of the hub. The drive roller is longitudinally loaded relative to the axle to achieve a wedge fit between the drive roller hub and the axle.

In an additional aspect of the present invention, at least one end of the frame is raised and lowered to selectively incline the support platform. To this end, a least one longitudinally curved, downwardly concave arm is mounted on and supported relative to the frame. The curved arm has a forward reaction end. A system is provided for longitudinally sliding the arm relative to the frame along the arc defined by the curved arm, thereby to extend and retract the forward reaction end of the curved arm relative to the frame.

In a further aspect of the present invention, the suspension system is also characterized by a linear resistance unit generating a level of resistance force in proportion to the speed at which the length of the linear resistance unit is altered. A connection assembly is employed to connect the linear resistance unit to the platform to change the speed at which the length of the linear resistance unit is altered as the platform pivots about the first axis.

BRIEF DESCRIPTION OF THE DRAWINGS

Exemplary embodiments of the present invention are illustrated in the accompanying drawings, in which.

DETAILED DESCRIPTION OF THE INVENTION

Figure 1:
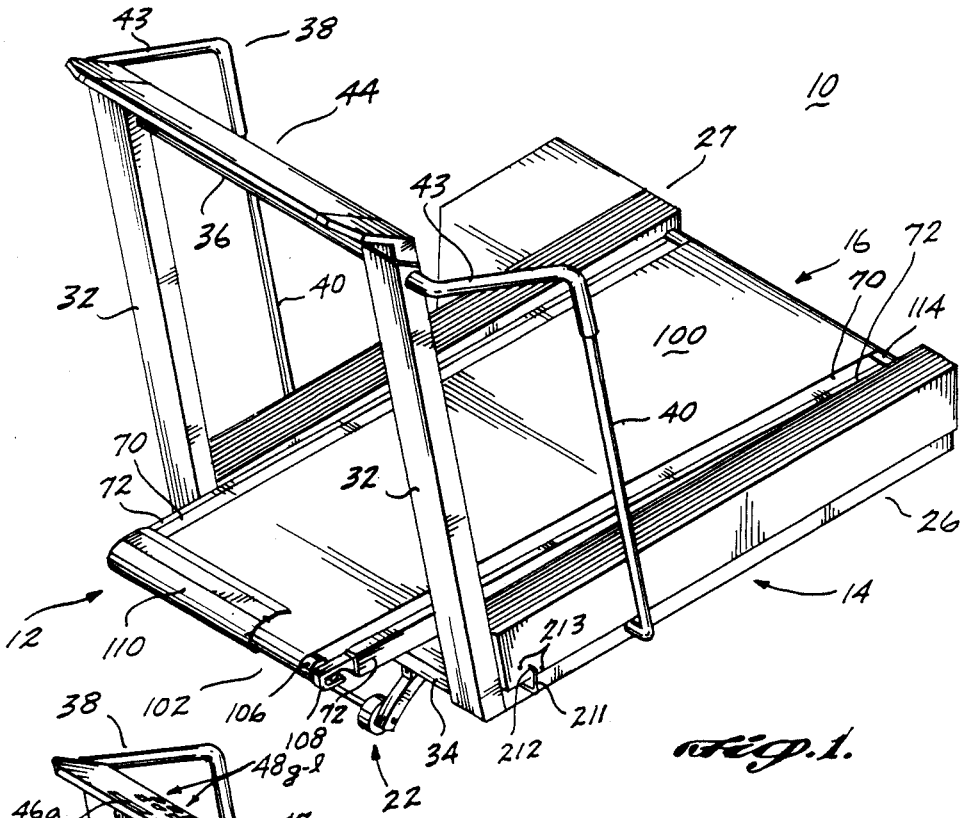
FIG. 1 is an isometric view of an embodiment of the present invention as viewed from the forward end of the unit, with portions broken away for clarity.
Figure 2:
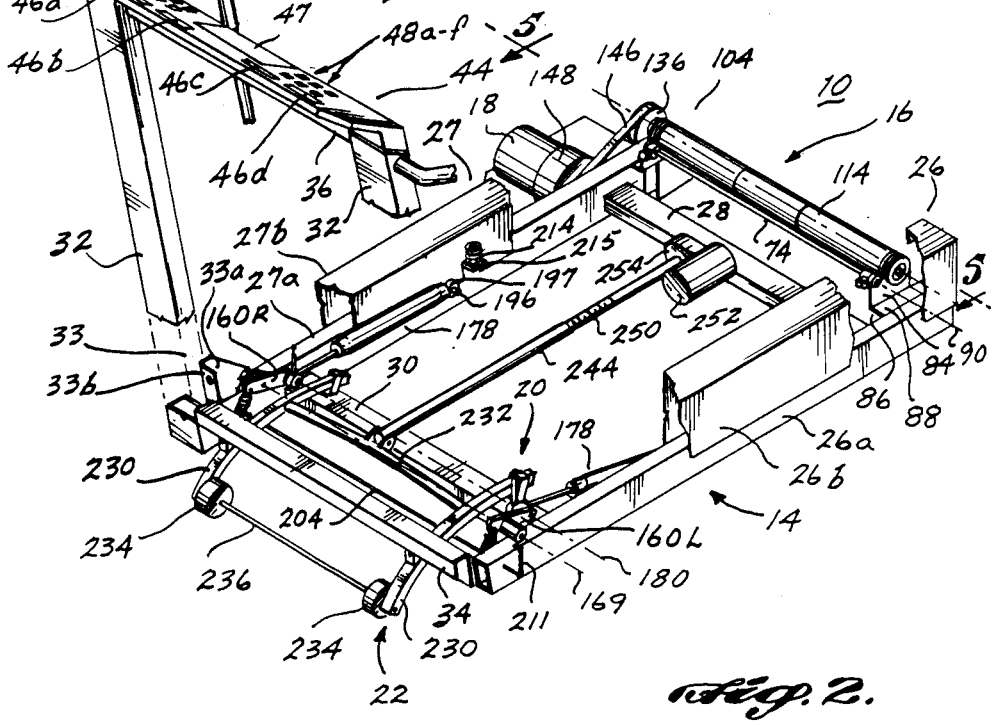
FIG. 2 is a view similar to FIG. 1 but with a belt assembly removed and portions of the frame broken away.

Referring initially to FIGS. 1 and 2, the present invention is illustrated as embodied in the form of an exercise treadmill. The exercise treadmill 10 includes a deck assembly 12 having a rear end portion pivotally mounted on an underlying frame 14. An endless belt assembly 16, mounted on the deck assembly, is powered by an electric motor 18. The forward end of the deck assembly 12 is supported by a suspension system 20 allowing the deck assembly to retract or yield in the downward direction at a graduated rate under the impact forces of a runner landing on the deck assembly, and then return upward to its nominal position as the runner is taking his next stride. The typical shock loads imparted on a runner's feet and legs by conventional exercise treadmills are largely avoided in the present invention. As a result, the likelihood of injury occurring to the runner, especially over a prolonged duration, is vastly decreased. The present invention also utilizes a lift mechanism 22 to raise and lower the forward end of the frame 14, for instance, to simulate running up an incline.

To more fully describe the present invention, the frame 14 is constructed with a pair of longitudinal side rails 26 and 27 each having lower, floor engaging tubular section 26*a* and 27*a*, respectively, and upper box sections 26*b* and 27*b*, respectively, disposed thereon. As shown in FIGS. 1, 2, 3*a* and 4, the upper box sections 26*b* and 27*b* extend laterally outwardly of their corresponding lower tubular sections 26*a* and 27*a*. The side rails 26 and 27 are interconnected by rearward and intermediate transverse cross members 28 and 30, respectively. For high strength relative to their weights, ideally the side rails and the rear and intermediate cross members of the frame 14 are all composed of tubular material or formed as box members of rectangular cross-sectional shapes.

A pair of front tubular posts 32 extend upwardly from the forward ends of the frame side rails 26 and 27 while sloping diagonally forwardly. The lower ends of the posts 32 are bolted to formed brackets 33 each having a longitudinal section 33*a* extending along the outer upper edges of the tubular sections 26*a* and 26*b* and a transverse section 33*b* extending across the front of the side rails 26 and 27 within the cross-sectional profile of the corresponding upper box sections 26*b* and 27*b*. Attachment bolts, not shown, extend thorough clearance holes formed in the bracket transverse section 33*b* and engage within the threaded opening in the posts 32. Below the brackets 33, a formed, inverted U-shaped front cross member 34 transversely interconnects the posts 32.

The upper ends of the posts 32 are interconnected by the center section 36 of a handrail 38. Ideally the ends of the handrail center section 36 extend through aligned clearance openings formed in the side walls of the front posts. The handrail 38 also includes formed side sections 40 that extend laterally outwardly from the front posts, curve substantially rearwardly an slightly downwardly and then curve substantially downwardly and slightly rearwardly to the elevation of the frame side rails 26 and 27. At the frame side rails, the handrail side sections 40 curve transversely inwardly to intersect the lower tubular sections 26*a* and 27*a* of the frame side rails. The lower ends of the side rail sections 40 may be secured to the outside walls of the tubular sections 26*a* and 27*a* by any appropriate method. Ideally, but not essentially, the handrail 38 is composed of round tubular material. Also, ideally at least the center section 36 and the upper portions of the side sections 40 of the handrail 38 are sleeved with a resilient grip material 43, such as closed cell foam, to assist the user in achieving a secure grip on the handrail.

Referring specifically to FIGS. 1 and 2, a tilted display panel 44 spans across the upper ends of the frame posts 32. As shown in FIG. 2, the display panel has a plurality of digital display areas 46*a*, 46*b*, 46*c* and 46*d* for displaying various workout parameters, such as the speed of the runner, the distance traveled, the duration of the run, the calories expended by the runner, the angle of inclination of the deck assembly 12, etc. A larger, center LED (light emitting diode) display 47 is employed to depict various courses that can be chosen by the runner or walker as well as the location of the runner/walker on the course. Control buttons 48*a* through 48*l* are located on the panel 44 to control various functions such as the speed of the endless belt assembly 16, the inclination of the functions such as the speed of the endless belt assembly 16, the inclination of the deck assembly 12, the course selected for running and the parameters selected for display, and also to bring the motor 18, and thus also belt assembly 16, to a rapid stop.

Figure 4:
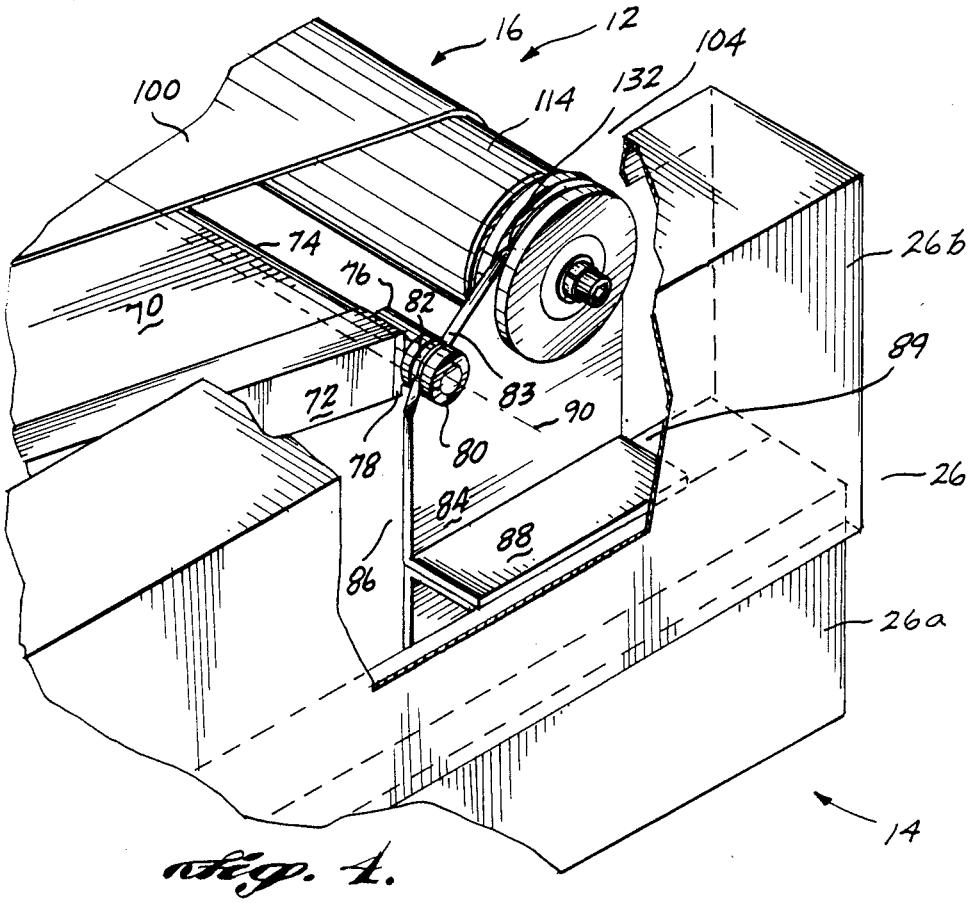
FIG. 4 is an enlarged, fragmentary, isomeric view of a rear portion of the present invention shown in FIG. 2, with portions broken away for clarity.

Next referring specifically to FIGS. 1, 2 and 4 the deck assembly 12 includes a longitudinal, rectangular shaped deck member 70 bordered along its sides by side reinforcing members 72. As shown in FIG. 1, the deck assembly 12 extends forwardly beyond front end of the frame 14. The back of the deck assembly 12 is pivotally mounted on the rear of the frame 14 through the use of a rear cross bar 74 extending across the rear of the deck member 70 and across the rear of the side members 72 to extend laterally beyond the side members. The cross bar 74 is attached to the deck side members 72 by the transverse collar portions 76 of end caps 78 which are secured to the rear ends of the side members 72. Grooved caps 80 are engaged over the laterally outwardly ends of the rear cross bar 74, which caps are each formed with a circumferential groove 82, sized for closely engaging within an outwardly open slot formed in the forward, upper edge portion 83 of the vertical web 84 of an L-shaped mounting bracket 86. The bottom flanges 88 of the brackets 86 overlap the upper surfaces of auxiliary frame portions 89 located along the insides of the frame lower tubular sections 26*a* and 27*a*. The width of the groove 82 is only slightly wider than the thickness of the bracket web 84 to prevent any appreciable movement of the deck assembly 22 laterally relative to the frame 14 while permitting the deck assembly to freely pivot relative to the frame about a transverse axis 90 coinciding with the central axis of the rear cross bar 74.

Next, referring primarily to FIGS. 1, 2 4 and 5, a belt assembly 16 is associated with the deck assembly 12 for presenting a moving operative surface to the runner or walker. The belt assembly 16 includes an endless belt 100 having its upper, operative surface riding over the top of the deck assembly 12, its forward and rearward ends trained around forward and rearward roller assemblies 102 and 104, respectively, and its bottom surface spaced slightly below the bottom of the deck assembly 12. The forward roller assembly 102 includes a forward idler roller 106 rotationally mounted on brackets 108 secured to the forward ends of the deck side members 72. The brackets 108 and roller 106 are shielded by a formed cover 110 spanning across the front of the deck assembly 12 to encase the forward roller and the end caps. It will be appreciated that the cover 110 not only protects the forward roller 106, but also by extending upwardly above the operative surface of the endless belt 100 reduces the likelihood that the runner's foot will land forwardly beyond the endless belt.

The rear roller assembly 104 includes a drive roller 114 mounted on a drive axle 116 by right and left end caps 118 and 120 which are pressed onto the interior of the ends of the drive roller. The end caps 118 and 120 have circular central bores 121R and 121L for receiving the drive axle 116. Ideally, the bore 121R formed in the right end cap 118 is formed with a slight taper in the outward direction to match a corresponding taper formed in the drive axle 116. Also, ideally the central bore 121L of the left end cap 120 of a constant diameter for snugly receiving a bushing 122 therein. Laterally outwardly of the end cap 120, the left end portion of the drive axle 116 engages through the inner race of an antifriction bearing 124, and correspondingly the portion of the drive axle 116 laterally outwardly from right end cap 118 engages through the inner race of an antifriction bearing 126. The outer races of the bearings 124 and 126 are pressed within generally disc-shaped bearing retainer 128. A groove 130 extends around the outer circumference of the bearing retainers. The groove 130 is sized to fit closely within an upwardly open slot formed in the rear upper edge portion 132 of the webs 84 of the mounting brackets 86. It will be appreciated by the foregoing construction that the rearward roller assembly 104 is held in engagement with the mounting brackets 86 without any further retention device.

Figure 5:
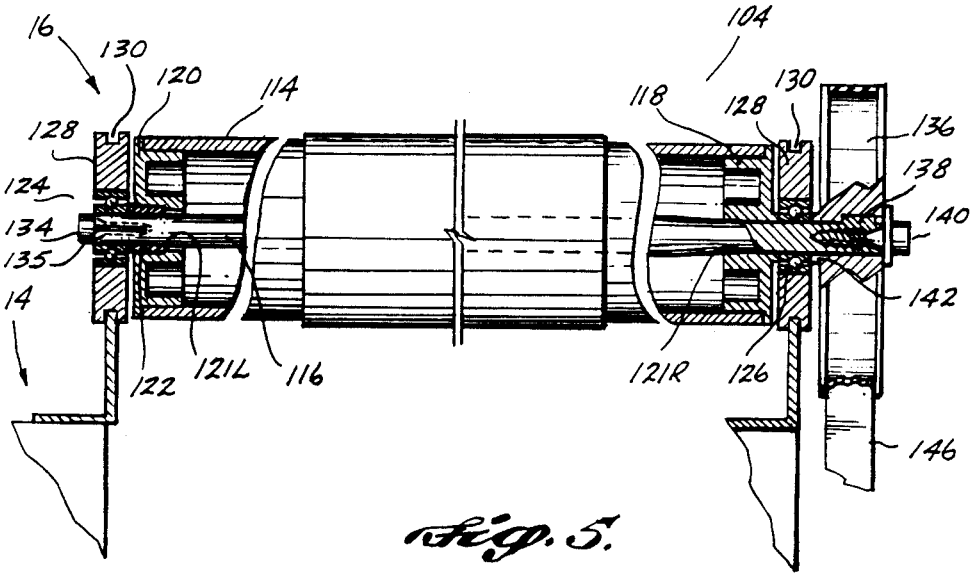
FIG. 5 is an enlarged, fragmentary rear elevational view, partially in cross section, of a rear drive roller of the present invention taken substantially along lines 5—5 of FIG. 2.

As illustrated in FIG. 5, the antifriction bearing 124 is retained on the left end portion of the drive axle 116 by a threaded hardware member 134 that engages within a tapered, threaded blind hole formed in the end of the drive axle. A diametrical cross slit 135 is formed in the end of the drive axle to allow the drive axle to expand outwardly as the hardware member 132 is threadably engaged with the axle. As a result, the end of the drive axle is securely engaged within the inside diameter of the bearing 124 without having to grind or otherwise precisely machine the end of the drive axle as would typically be required.

A drive pulley 136 is engaged over the right end of the drive axle 116. A key 138 is engaged within a close-fitting keyway formed longitudinally in the right end of the drive axle 116 and within a corresponding keyway formed in the wall of a bore extending through the center of the pulley 136 to prevent relative rotational movement between the pulley and the drive axle. It will be understood that other standard methods could be employed to prevent relative rotational movement between these two components. For instance, the end of the drive axle could be formed with male spines to match female spines formed in the inside diameter of the drive pulley 136. A threaded hardware member 140 is engaged within a threaded blind hole formed in the right end of the drive axle 116, thereby tightly clamping the center portion of the right end cap 118 to one side of the inner race of the bearing 126, while tightly clamping the central hub 142 of the drive pulley 136 to the opposite side of the bearing inner race. It will be appreciated that the tightening of the hardware member 140 will cause the tapered section of the drive axle 116 wedge tightly within the correspondingly tapered central diameter of the right end cap 118 to prevent any relative rotation therebetween.

The pulley 136 is driven by an electric motor 18 through the intermediacy of a drive belt 146 in a standard manner in powered exercise equipment, including exercise treadmills, of the nature of the present invention. A flywheel 148 is mounted on the output shaft of the motor 18 to help ensure that the endless belt 100 will be driven at constant speed even when the runner's feet land on the endless belt.

Figures 3A, 3B:
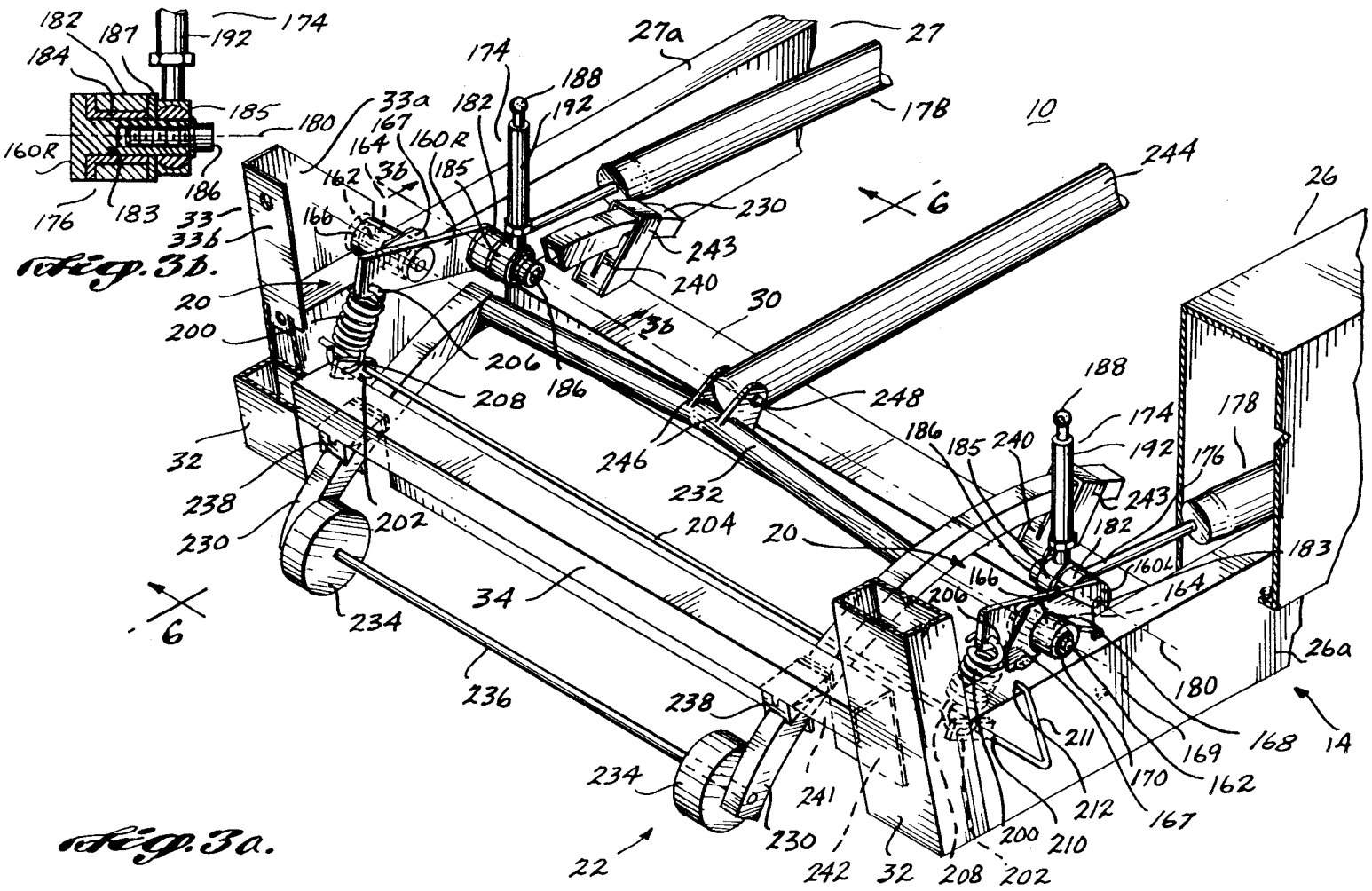
FIG. 3*a* is an enlarged, fragmentary isometric view of the forward portion of the present invention shown in FIG. 2, with portions broken away for clarity.
FIG. 3*b* is an enlarged, fragmentary, cross-sectional view of a portion of the present invention shown in FIG. 3*a* taken substantially along lines 3*b*—3*b* thereof.
Figure 6:
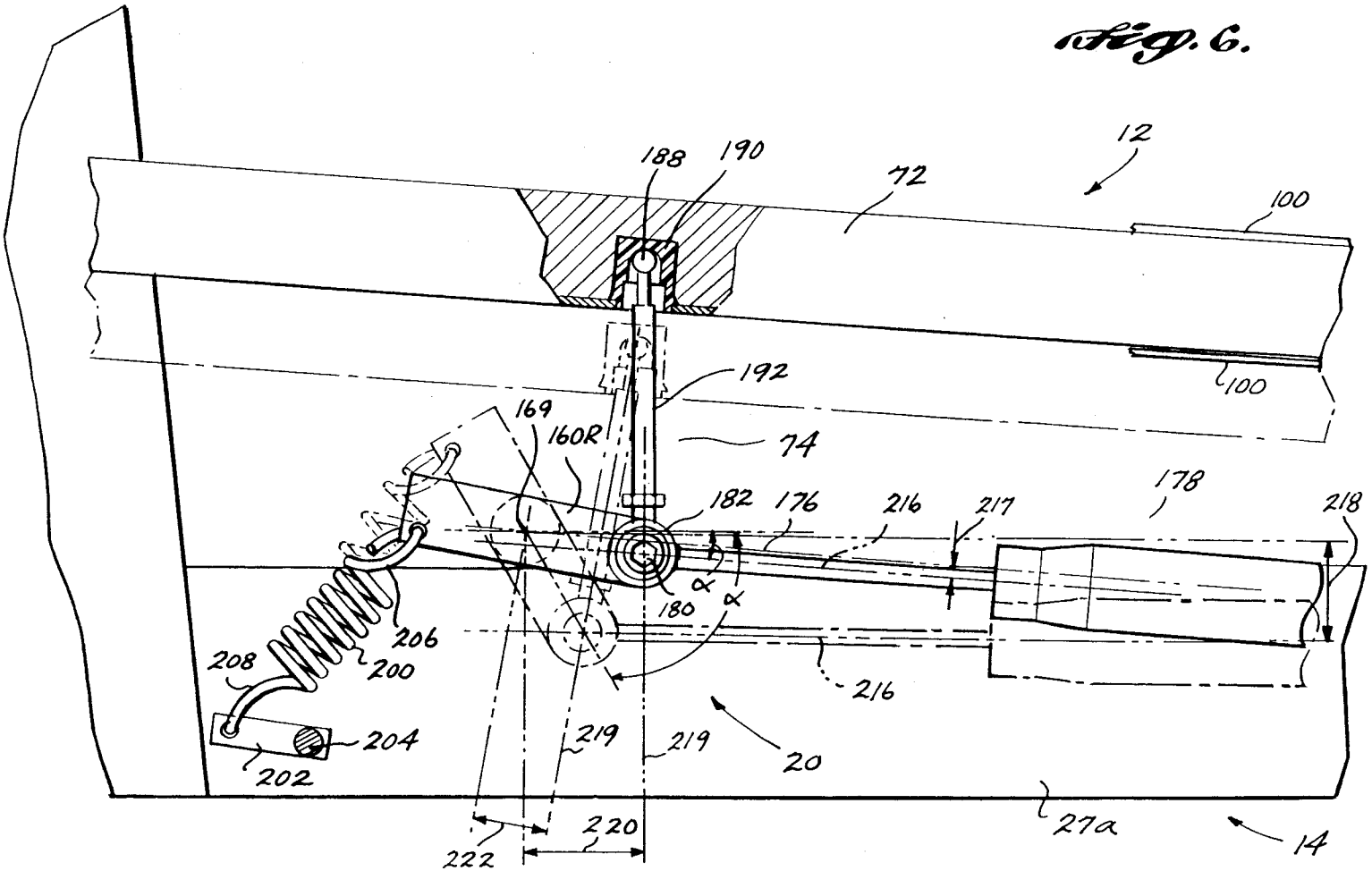
FIG. 6 is an enlarged, fragmentary side elevational view of the present invention taken substantially along lines 6—6 of FIG. 3*a;* and, FIG. 7*a*, 7*b* and 7*c* are enlarged, fragmentary side elevational views illustrating an alternative preferred embodiment of the present invention.
Figure 7A:
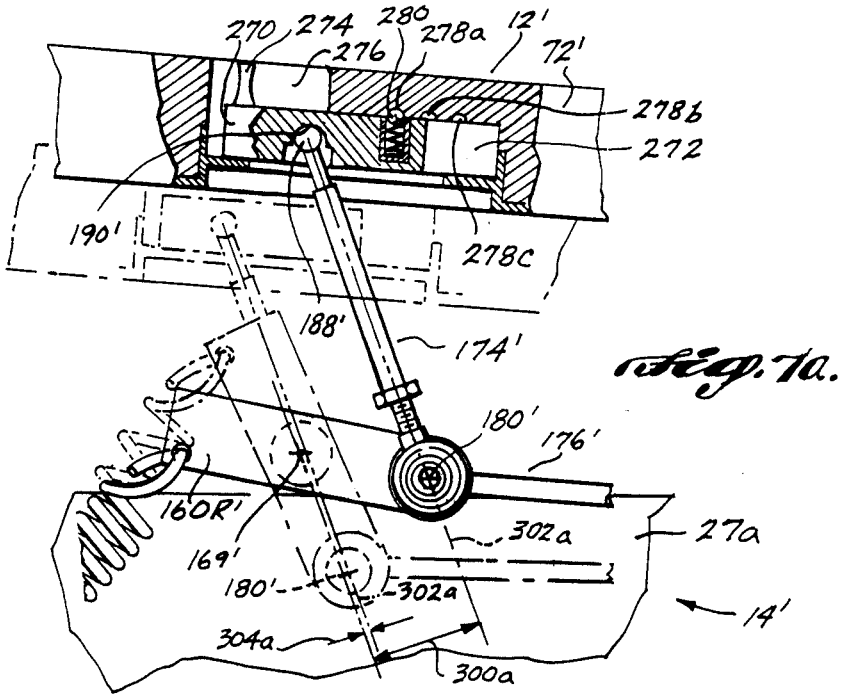
Figure 7B:
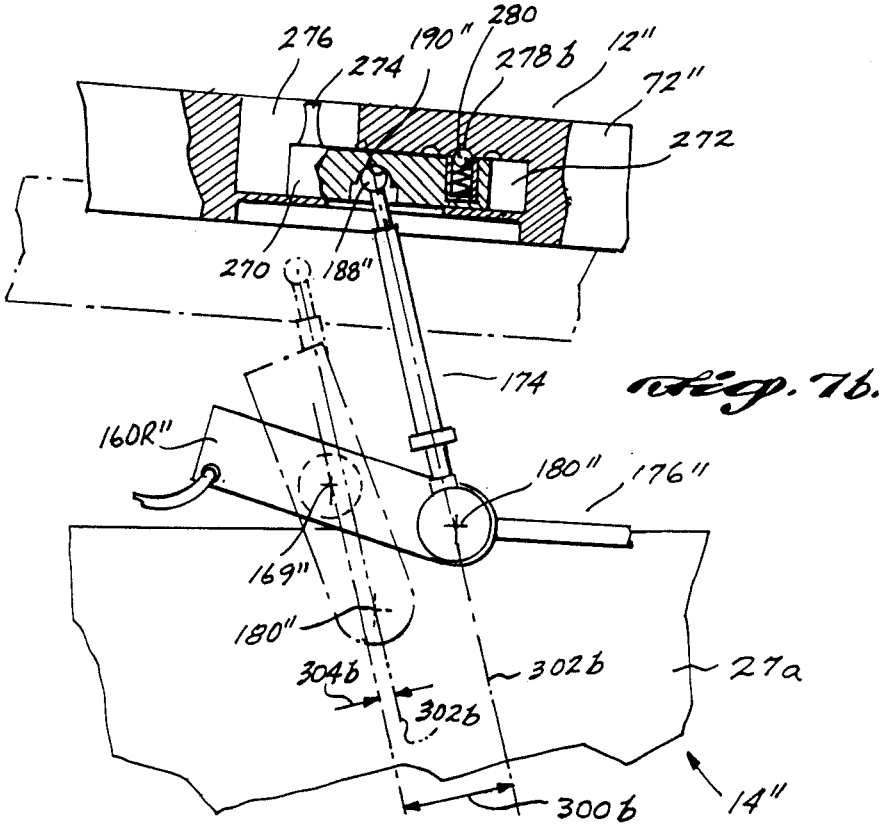
Figure 7C:
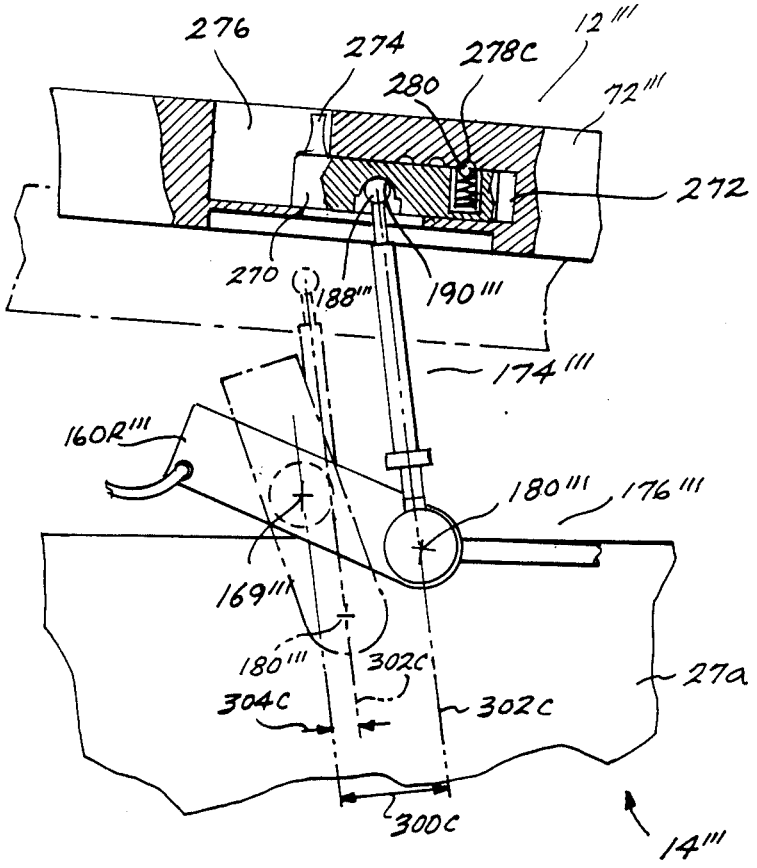

As most clearly shown in FIGS. 2, 3*a* and 6, the suspension system 20 for the deck assembly 12 includes pivotable lever arms 160L and 160R mounted on the upper surface of the lower tubular rail sections 26*a* and 27*a* at the forward ends of the frame side rails 26 and 27 along each side of the deck assembly 12. Stub shafts 162 extend transversely outwardly from the lever arms 160L and 160R to engage within close-fitting bushings 164 disposed within cylindrical hubs 166 mounted on the upper surface of frame lower tubular sections 26*a* and 27*a* by the rear portion of the side sections 33*a* of the post brackets 33. The inward ends of the hubs 166 are secured to the tubular sections 26*a* and 27*a* by upright plates 167. A diagonal wedge plate 168 extends diagonally downwardly from the rear side of the hubs 166 to the upper surface of the frame lower tubular sections 26*a* and 27*a*. The shafts 162 cooperatively define the pivot axis 169 of the lever arms 160L and 160R. A snap ring 170 or other appropriate hardware member is employed to retain the stub shafts 162 engaged with the hubs 166.

Referring additionally to FIG. 3*b*, the lower end of a rocker arm assembly 174 and the forward, free rod end 176 of a linear actuator, in the form of a fluid cylinder or shock absorber 178, are pivotally and antifrictionally mounted on the rearwardly extending end of the lever arms 160L and 160R to pivot about a common axis 180. To this end, a circular eye 182, formed at the forward, free end 176 of the shock absorber 178, engages a close-fitting stub shaft 183 extending transversely from the inside face of the lever arms 160L and 160R. Ideally, a bushing 184 or other antifriction device is interposed between the eye 182 and the stub shaft 183 to minimize friction resistance therebetween. Also, a spherical socket 185, composing the lower end of the rocker arm assembly 174, is also engaged over the stub shaft 183. A threaded bolt 186 is engaged with a threaded central, blind bore formed in the stud shaft 183 to retain the eye 182 and spherical socket 185 on the stub shaft. A washer 187 is positioned between the eye 182 and the adjacent spherical socket 185 to allow these components to freely pivot relative to each other.

The upper end of each of the rocker arm assemblies 174 is composed of a ball stud 188 for engaging within close-fitting socket 190 pressed within a blind bore formed in the underside of the deck side members 72. It will be appreciated that the length of the rocker arm assemblies 174 may be adjusted by varying the engagement of the lower spherical socket 185 and upper ball stud 188 within the threaded ends of the rod or shank portion 192 of the rocker arm assemblies. The lengths of the rocker arm assemblies 174 can be changed to alter the nominal height or elevation of the forward end of the treadmill deck assembly 12.

The rear ends of the shock absorbers 178, as shown in FIG. 2, are mounted on studs 196 extending transversely outwardly from the inner side walls of the lower tubular sections 26*a* and 27*a* of the frame side rails 26 and 27. Eyes 197 are formed in the rearward attachment portions of the shock absorbers to engage over the studs 196. Ideally, the shock absorbers 178 act as "one-way" shock absorbers or dampers to resist extension of the shock absorbers cylinders but permit substantially free compression of the shock absorbers. Shock absorbers of the nature of dampeners/shock absorbers 178 are standard items of commerce.

The lever arms 160R and 160L are biased to return the deck assembly 12 upwardly to its nominal position by extension springs 200 acting between the forward ends of the lever arms and the forward ends of pivot arms 202 extending nominally forwardly from a cross rod 204 spanning between the forward ends of the frame side rails 26 and 27. As shown in FIGS. 3*a* and 6, a hook 206 at one end of the extension spring 200 engages through a cross hole formed in the forward end of the lever arms 160R and 160L. A second hook 208 at the opposite end of each extension spring 200 extends through a cross hole formed in the forward end of the pivot arm 202, which pivot arm projects transversely and generally forwardly from the cross rod 204. The cross rod pivots within aligned cross holes 210 formed in the frame side rails 26 and 27. The left hand end 211 of the cross rod 204, as shown in FIGS. 1 and 3*a*, is formed in a U- or hook-shape to define a terminal end portion 212 which is engageable within one of a series of cross holes 213 formed in the exterior side wall of the frame side rail 26. It will be appreciated that the cross rod 204 is capable of sliding along its length within the cross holes 210 to permit the terminal end 212 of the cross rod to be disengaged from one of the holes 213, the cross rod pivoted, and then the terminal end of the cross rod reinserted into another hole 213. The particular hole 213 within which the terminal end 212 of the cross rod 204 is inserted affects the nominal angular orientation of pivot arms 202 about the cross rod which in turn varies the level of the biasing load being applied to the pivoting lever arms 160R and 160L. It will be appreciated that the hook 211 could alternatively or in addition be formed in the opposite end of the rod 204.

Referring specifically to FIG. 2, the lower end of a compression spring 214 is mounted on a retainer ledge 215 projecting transversely inwardly from the inside wall of frame side rail 27 at a location intermediate the ends of the frame side rail. The upper end of the compression spring 214 bears against the underside of the corresponding deck assembly side member 72. The compression spring 214 functions to assist in upwardly supporting the deck assembly 12.

To describe the operation of the suspension system 20, a runner's forward foot initially lands on the forward on the forward end of the deck assembly 12, is carried rearwardly along the deck assembly by the moving endless belt 100 past the opposite foot and then is lifted off the deck assembly by the runner a short time prior to the landing of the runner's opposite foot on the forward end of the deck assembly. As the runner's foot lands on the deck assembly, the downward force imposed thereby on the deck assembly causes the deck assembly to pivot downwardly about the rear axis 90. The suspension system of the present invention imparts a progressively increasing reaction force on the descending deck assembly and absorbs much of the energy applied to the descending deck assembly by the runner, thereby reducing the shock loads that would otherwise be transmitted to the runner's body by landing on an unyielding surface.

In basic operation of the suspension system, the downward movement of the deck assembly 12 and thus also the rocker arm assemblies 174 causes the lever arms 160R and 160L to pivot clockwise about the axis 169, (FIG. 6). This results in an extension of the fluid shock absorbers 178 and also extension of the springs 200 and compression of the spring 214. As described more fully below, in essence, the descent of the deck assembly 12 results in an increase in the mechanical advantage or "leverage" of shock absorbers 178 acting on the lever arms 160R and 160L and a decrease in the mechanical advantage or "leverage" of the rocker arm assemblies 174 acting on the lever arms, and also an increase in the speed at which the shock absorbers are extended. These conditions increase the resistance or "stiffness" of the suspension system 20 and cause the damping force applied to the lever arms 160R and 160L to progressively increase during the descent of the deck assembly.

To further elaborate, when the deck assembly 12 is in its nominal, fully upward position, the line of action 216 of the shock absorbers 178 (extending along the length of the shock absorbers) is at an effective distance 217 from the pivot axis 169 of the lever arms 160R and 160L (shown in solid line in FIG. 6). As the deck assembly descends, the lever arms 160R and 160L pivot in the clockwise direction toward the position shown in dotted line in FIG. 6, causing the junction axis 180 to swing about the pivot axis 169 of the lever arms to progressively increase the effective distance separating the line of action 216 of the shock absorbers 178 and the pivot axis 169. By the time the lever arms are in the broken line position shown in FIG. 6, the line of action 216 of the shock absorbers has incrementally increased to an effective distance 218 from the pivot axis 169. This increase in the effective distance is essentially an increase in the mechanical advantage or leverage of the shock absorbers on the lever arms.

Concurrently with the increase in the effective distance (from 217 to 218) of the line of action 216 of the shock absorbers from the pivot axis 169, the line of action 219 of the rocker arm assemblies 174 (coexistive with the length of the rod 192) shifts significantly closer to the pivot axis 169 of the lever arms 160R and 160L as the lever arms rotate from the solid line position shown in FIG. 6 to the broken line position. For example, as shown in FIG. 6, with the deck assembly 12 in its nominal position, the line of action 219 of the rocker arm assemblies 174 is at an effective distance 220 from the pivot axis 169 of the lever arms 160R and 160L. As the lever arms 160R and 160L pivot in a clockwise direction toward the position shown in dotted line in FIG. 6 due to the displacement or lowering of the deck assembly, the line of action 219 of the rocker arm assemblies moves toward the pivot axis 169 a significantly decreased effective distance 222. As a result, the mechanical advantage or leverage of the rocker arm assemblies 174 on the lever arms is significantly decreased.

As the deck assembly 12 descends, the increase in the leverage of the shock absorbers 178 is related to the decrease in the leverage of the rocker arm assemblies 174 essentially as a function of the tangent of the angle $\alpha$ that the lever arms 160R and 160L are from a horizontal reference line, as shown in FIG. 6. Thus, since the tangent of the angle $\alpha$ increases significantly as the lever arm pivots from the solid line position to the broken line position shown in FIG. 6, especially when the angle $\alpha$ is greater than $\mu/2$, the damping resistance provided by the shock absorbers increases significantly with the clockwise rotation of the lever arms 160R and 160L, and thus also with the downward movement or depression of the deck assembly 12.

The novel suspension system 20 of the present invention in addition to increasing the mechanical advantage of the shock absorbers 178 on the lever arms 160R and 160L during descent of the deck assembly 12, concurrently causes the shock absorbers 178 to be extended at an increasing rate. The fluid shock absorbers 178 are of a "one-way" design to resist extension, thereby absorbing energy during their extension while imposing very little resistance to their retraction or shortening. As in typical dampening devices, the capacity of the shock absorbers 78 to absorb energy is a function of the square of the velocity at which the shock absorbers are extended in length.

It will be appreciated that as the lever arms 160R and 160L begin to pivot in a clockwise direction, shown in FIG. 6, about the pivot axis 169 from the position shown in solid line toward the position shown in dotted line, due to the initial orientation of the lever arms (generally aligned with the shock absorbers), at first the fluid shock absorbers 178 extend very little relative to the amount of elevational descent of the deck assembly 12. Since the resistance imposed by the shock absorbers 178 to the rotation of the lever arms 160R and 160L is a function of the rate at which the shock absorbers are extended, the shock absorbers initially do not exert significant resistance to the rotation of the lever arms. However, as the lever arms rotate further about the pivot axis 169 toward the position shown in dotted lines in FIG. 6, the pivot joint 180 between the lever arms 160R and 160L with the shock absorbers 178 moves at a faster rate away from a line extending between the axis 169 and shock absorber mounting stud 196. This results in the shock absorbers being extended at a substantially faster rate relative to the rate of downward descent of the deck assembly 12. As such, the shock absorbers 178 exert a progressively increasing level of damping on the deck assembly relative to the amount of damping exerted by the shock absorbers during the initial descent of the deck assembly.

The damping force that the shock absorbers apply to the lever is a function of the square of the rate of descent of the deck assembly 12 and the cube of the tangent of the angle $\alpha$. This is a reflection of the geometry of the suspension system 20 as well as the fact that the damping resistance provided by the shock absorbers is a function of the square of the velocity at which the shock absorbers are extended. It will be appreciated that unless the descending velocity of the deck assembly 12 is near zero, the damping resistance exerted by the shock absorbers 178 predominates in producing a reaction force in opposition to the rotation of the lever arms 160A and 160L. Although certain amount of resistance to the rotation of lever arms is produced by the extension of the springs 200 and the compression of the auxiliary spring 214, preferably the total resistance provided by these springs is only a fraction of the resistance generated by the shock absorbers 178.

As a result of the foregoing, the resistance to the downward movement of the deck assembly 12, and thus also the runner's foot, progressively increases as the deck assembly is displaced in a downward direction. Eventually the downward force being applied to the deck assembly by the runner is matched by the resisting force imparted on the deck assembly by the shock absorbers 178 and the springs 200 and 214, so that by the time the runner's foot reaches point where it has to shove off the deck assembly 12, the suspension system 20 is substantially rigid. The deceleration of the runner's foot during football occurs much more gradually then if a substantially constant resistance force were applied to the deck assembly, for instance through the use of compression springs similar to auxiliary springs 214. Accordingly, the shock (which can be considered to be the rate of change of acceleration) imposed on the runner's feet, and legs is substantially decreased through the present invention, providing a reduction in the likelihood of injuries sustained by the runner, especially over prolonged periods of time.

When both of the runner's feet are momentarily lifted off the deck assembly 12, the springs 200, acting on the forward end of the lever arms 160R and 160L, cause the lever arms to pivot counterclockwise (as shown in FIG. 6) about the axis 169, thereby push the forward end of the deck assembly back upwardly to the nominal position. In this regard, the springs 200 are assisted by the auxiliary spring 214. As mentioned above, the counterclockwise rotation of the lever arms 160R and 160L is not resisted by the shock absorbers. As such, the deck assembly is capable of being returned to its nominal position in a very short time span, typically a fraction of a second.

To accommodate runners of various weights, the initial biasing force imposed on the lever arms 160R and 160L by the springs 200 may be adjusted by changing the position of the pivot arms 202 associated with the cross 204 by selective engagement of the cross rod terminal end 212 within the reception holes 213. Rotation of the pivot arms 202 in the counterclockwise direction shown in FIG. 6 results in a corresponding counterclockwise nominal rotation of the lever arms 160R and 160L, thereby decreasing the initial angle $\alpha$ and the initial effective distance 217 separating the line of action 216 of the shock absorbers 178 from the lever arm pivot axis 169. As a result, the suspension system 20 is adjusted to a "less stiff" mode permitting increased downward displacement of the forward end of the deck assembly 12 than if the pivot arms 202 were positioned to nominally orient the lever arms 160R and 160L in a more clockwise orientation. If the lever arms 160R and 160L are initially positioned in a more clockwise orientation, the initial angle $\alpha$ and the initial effective distance 217 separating the line of action 216 of the shock absorbers 178 from the pivot axis 169 would be increased, thereby increasing the initial mechanical advantage of the shock absorbers. As a result, the lever arms pivot through a shorter are for a give load imposed on the deck assembly, resulting in a more stiff configuration of the suspension system 20.

From the foregoing construction it will be appreciated that various alterations can be made in the suspension system 20 without departing from the spirit or scope of the present invention. For instance, rather than being mounted on the frame side rails 26 and 27, the lever arms 160R and 160L can be instead mounted in "reverse position" on the deck assembly 12. In this configuration, the shock absorbers 178 and the cross rod 204 would also be mounted on the deck assembly, and the free end of the rocker arm assemblies 174 would push downwardly against the frame 14 rather than upwardly against the deck assembly. One disadvantage of reversing the position of the suspension system in this manner is that the sprung weight of the deck assembly would be increased, thereby increasing the level of energy which would have to be absorbed by the shock absorbers 178 and resisted by the spring 200 and 214.

It will also be appreciated that, in theory, the shock absorbers 178 could be eliminated, with the function of the shock absorbers being accomplished by significantly increasing the stiffness of the springs 200 and/or 214. Unfortunately, this would result in a decrease in the downward travel distance of the deck assembly, and thus likely would increase the shock experienced by the runner's feet.

As a further alternative, it is possible that the shock absorbers 178 and springs 200 and/or spring 214 may be replaced by a combination shock absorber spring unit, which are commonly commercially available. As a further possible alternative, the shock absorbers 178 and springs 200 and/or spring 214 may be replaced by a gas filled shock absorber which exhibits both the damping characteristics of a standard shock absorber and the load carrying characteristics of a spring.

Next referring specifically to FIGS. 2 and 3*a*, the lift mechanism 22 of the present invention includes a pair of tubular, arcuate arms 230 disposed longitudinally alongside the inward sides of the frame side rails 26 and 27. The arms are curved in a concave downward direction and are interconnected intermediate their ends by a transverse cross bar 232. A pair of rollers or wheels 234 are engaged on an axle 236 interconnecting the forward ends of the arcuate arms 230.

The arcuate arms 230 are constrained to move only in the fore and aft directions by forward and rearward guides 238 and 240. The forward guides 238 are generally wedge-shaped, having an arcuate lower surface corresponding to the curvature of the arms 230. The forward guides 238 are engageable within a downwardly open slot 241 formed in the rear wall 242 of the forward cross member 34 of the frame 4. Preferably, the forward guide 238 is formed from a reduced friction material, such as a plastic or nylon.

The rear guides 240 are held in place on the top of the intermediate cross member 30 by U-shaped retainer 243. The upper surfaces of the rear guides 240 are curved to match the curvature of the underside of the arcuate arms 230. As with the forward guides 238, preferably the rearward guides 240 are composed of a reduced friction material, such as plastic or nylon. It will be appreciated that at their forward ends, the arms 230 bear upwardly against the forward guides 238, while at their rearward ends, the arm bear downwardly against the rearward guides 240.

As illustrated in FIG. 3*a*, the two arcuate arms 230 are in unison pushed forwardly or pulled rearwardly by an actuating tube 44 which is pivotally pinned to spaced apart ears 246 projecting transversely rearwardly from cross bar 232 by a cross pin 248 extending through aligned cross holes formed in the ears and also through aligned clearance holes formed in the actuating tube. Referring additionally to FIG. 2, at its rearward end, the actuating tube 244 is threadedly engaged with a screw shaft 250. The screw shaft 250 is rotated relative to the tube 244 by an electric motor 252 through the use of a speed reduction unit 254. The operation of the electric motor 250 is controlled by control buttons 48 mounted on the display panel, discussed above.

It will be appreciated that by the foregoing construction, the lift mechanism 22 is disposed entirely beneath the deck assembly 12 and between the sides of the frame 14, thereby maintaining the pleasing appearance of the present invention. In typical treadmill lift mechanisms, components of the mechanism protrude upwardly above the elevation of the deck assembly.

An alternative preferred embodiment of the present invention is illustrated in FIGS. *7a, 7b* and *7c*, wherein a socket 190 ' for receiving the upper end 188' of a rocker arm assembly 174', is integrated within a longitudinal slide 270 disposed within a slidaway 272 formed in the side members 72' of the deck assembly 12'. The components of the present invention, illustrated in FIGS. *7a, 7b* and *7c*, corresponding to similar components shown in FIGS. 1–6 are indicated with the same part number, but with the addition of a prime (') designation. The slide 270 may be longitudinally shifted by operation of a knob 274 extending upwardly from the slide within a clearance slot 276 formed in the deck side members 272 above the slide 270. Preferably, the top of the knob 274 does not protrude above the top surface of the deck side members 72', thereby to prevent the knob from being accidentally shifted by the runner's foot. A cover, not shown, can be provided to close off the top of the slot 276. A plurality of detents, for example, 278*a*, 278*b* and 278*c*, can be formed within the deck side members 72' for reception of a spring-loaded detent ball 280 mounted within the slide 270. As will be appreciated, the engagement of the detent ball 280 within the detents 278*a*, 278*b* and 278*c* enables the slide to be shifted to specific locations along the slideway and held in place until being shifted again.

As illustrated in FIGS. *7a, 7b* and *7c*, the position of the socket 190' along the deck side member 72' has an effect on the effective distances between the lines of action of the rocker arm assembly 174' and the pivot axis 169' of the lever arms 160L' and 160R. The lever arms are depicted in solid line in their maximum counterclockwise position (deck assembly 12' in nominal, fully up location) and depicted in dotted line in clockwise position (deck assembly 121 in fully downwardly displaced location) about axis 169'. The lines of action for the various positions of the socket 190' are illustrated in FIGS. *7a, 7b* and *7c*.

As illustrated in FIGS. *7a* and *7b*, when the socket 190' is positioned so that the detent ball 280 is within detent 278*a*, the initial effective distance 300*a* between the line of action 302*a* of the rocker arm assembly 174' and the pivot axis 169' is less than the initial effective distance 300*b* between the line of action 302*b* of the rocker arm assembly and the pivot axis 169' when the detent ball 280 is within detent 278*b*. This also holds true for the effective distance 304*a* between the line of action 302*a* of the roller arm assembly 174' and the pivot axis 169 when the rocker arm assembly is in the rotated position shown in dotted line in FIGS. *7a* and *7b*. Thus, positioning the socket 190' so that the detent ball 280 is engaged with detent 278*a* constrains the lever arms 160L' and 160R' to rotate through a smaller arc for a given load imparted on the deck assembly 12' by the runner's foot. As such, the suspension system 20' is adjusted to a stiffer position than if the detent ball were disposed within detent 278*b*.

Conversely, when the socket 190' is shifted in the opposite direction so that the detent ball 280 is disposed within detent 278*c*, the effective distances 300*c* and 304*c* separating the line of action 302*c* of the rocker arm assembly 174' from the pivot axis 169' is increased. This permits the lever arms 160L' and 160R' to pivot about a larger arc for a given load imposed on the deck assembly 12'. As a result, the suspension system 20' is adjusted to a "softer" condition.

It will be appreciated that by adapting the socket 190' to shift longitudinally along the deck side members 72', the function of the pivot arms 202 of the embodiment of the present invention shown in FIGS. 1–6 may be replaced and/or augmented. Thus, in the embodiment of the present invention shown in FIGS. *7a, 7b* and *7c*, it is possible to adjust the suspension system 20' along a larger range than is possible by utilizing the pivot arms 202 themselves.

Other than as described above, the construction and operation of the embodiment of the present invention shown in FIGS. *7a, 7b* and *7c* is the same as the embodiment shown in FIGS. 1–6. As such, the same advances in the art and advantages provided by the preferred embodiment of the present invention shown in FIGS. 1–6 are also provided by the preferred embodiment of the present invention shown in FIGS. *7a, 7b* and *7c*.

It is to understood that while preferred embodiments of the present invention have been illustrated and described various changes can be made therein without departing from the spirit or scope of the present invention. For instance, the present invention may be adapted to exercise devices other than exercise treadmills. Accordingly, the present invention is defined by the following claims rather than being limited to the specific embodiments of the present invention described above.

The embodiments of the invention in which an exclusive property or privilege is claimed are defined as follows:

1. An exercise treadmill apparatus, comprising:

(a) a frame;

(b) support platform means pivotally mounted on the frame about a pivot axis; and, (c) a suspension system for supporting the support platform means relative to the frame and permitting the support platform means to displace relative to the frame about the pivot axis of the support platform means between a nominal position and a displaced position under loads imparted on the support platform means during use of the apparatus, the suspension system comprising:

(i) at least one lever arm pivotally mounted on the frame to pivot about a pivot axis between a nominal orientation and a displaced orientation;

(ii) first connection means pivotally interconnecting the lever arm at a location spaced from the pivot axis of the lever arm with the support platform means at a location spaced from the pivot axis of the support platform means;

(iii) first resistance means applying a force on the pivoting lever arm to resist the rotational movement of the lever arm in a first rotational direction about the pivot axis of the lever arm corresponding to the rotation of the lever arm from its nominal orientation to its displaced orientation under loads imposed on the support platform means during use of the apparatus, with the magnitude of the resisting force applied by the first resistance means being dependent on the angular orientation of the rotating lever arm; and, (iv) means for applying a return force on the support platform means to return the support platform means to its nominal position between sequential loads imposed on the support platform means during use.

2. The exercise apparatus according to claim 1, wherein the magnitude of a resisting force applied to the lever arm by the first resistance means is also dependent upon the rate of change of angular orientation of the rotating lever arm.

3. The exercise apparatus according to claim 1, wherein the first resistance does not apply a significant resistance to the rotational movement of the lever arm about the pivot axis of the lever arm in the direction opposite to the first rotational direction of the lever arm.

4. The exercise apparatus according to claim 1, wherein the first resistance means including means to dampen the rotational movement of the lever arm in the first rotational direction about the pivot axis of the lever arm.

5. The exercise apparatus according to claim 4, wherein the damping means does not significantly impede the rotation of the lever arm about the pivot axis of the lever arm in the direction opposite to the first rotational direction of the lever arm.

6. The exercise apparatus according to claim 1, further including second connection means for connecting the first resistance means to the lever arm at a location spaced from the second pivot axis whereby as the lever arm pivots about the pivot axis of the lever arm in its first rotational direction, the effective distance separating the line of action of the first resistance means from the pivot axis of the lever arm increases.

7. The exercise apparatus according to claim 6, wherein the first resistance means includes damping means operatively connected to the lever arm to dampen the rotational movement of the lever arm in the first rotational direction about the pivot axis of the lever arm.

8. The exercise apparatus according to claim 7, wherein the damping means includes a fluid shock absorber interconnected between the lever arm and the frame.

9. The exercise apparatus according to claim 1, wherein the first connection means includes link means having a first end portion pivotally connected to the lever arm at a location spaced from the pivot axis of the lever arm and the second end portion pivotally connected with the support platform means at a location spaced from the pivot axis of the support platform means.

10. The exercise apparatus according to claim 9, wherein the line of action of the link means shifts closer to the pivot axis of the lever arm as a lever arm rotates in the first rotational direction about the pivot axis of the lever arm.

11. The exercise apparatus according to claim 9, wherein the link means includes a push rod pivotally connected at one end to a distal portion of the lever arm and pivotally connected at the opposite second end to the support platform means.

12. The exercise apparatus according to claim 11, further comprising means for varying the location at which the second end portion of the push rod is connected to the support platform means thereby to alter the effective distance separating the line of action of the link means from the pivot axis of the lever arm.

13. The exercise apparatus according to claim 1, further comprising means for varying the nominal position of the lever arm.

14. The exercise apparatus according to claim 1, further comprising second resistance means applying a force on the lever arm to resist the rotational movement of the lever arm in the first rotational direction about the pivot axis of the lever arm and applying a biasing force on the lever arm when the lever arm is in an orientation displaced from its nominal orientation tending to rotate the lever arm about the pivot axis of the lever arm in the direction opposite to the first rotational direction of the lever arm.

15. The exercise apparatus according to claim 14, further including means for selectively adjusting the magnitude of the biasing force imposed on the lever arm by the second resistance means.

16. The exercise apparatus according to claim 1, further comprising biasing means acting on the lever arm when in displaced orientation to bias the lever arm for rotation about the pivot axis of the lever arm in the direction opposite to the first rotational direction of the lever arm about the pivot axis of the lever arm.

17. The exercise apparatus according to claim 16, further comprising means for varying the biasing force applied to the lever arm by the biasing means.

18. The exercise apparatus according to claim 1, wherein the support platform means comprises: a deck; an endless belt; and, means for mounting the endless belt on the deck to present a moving surface of the endless belt on the top of the deck.

19. The exercise apparatus according to claim 18, wherein the belt mounting means includes a drive roller assembly mounted in association with the deck, the belt trained around the drive roller assembly.

20. The exercise apparatus according to claim 19, wherein the drive roller assembly comprises an axle, an elongate roller mounted on the axle, antifriction mounting means for antifrictionally mounting the axle in association with the deck, and drive means connected to the axle to transmit rotational torque to the axle.

21. The exercise apparatus according to claim 20, wherein:

the elongate roller includes a hub having a tapered center bore;

the axle is tapered to match the taper of the roller hub; and, the drive roller assembly further comprising means for drawing the axle relative to the roller hub to achieve a wedge fit therebetween.

22. The exercise apparatus according to claim 19, wherein the support platform means further includes a bracket means mounted on the frame for rotatably supporting the drive roller assembly and also pivotally supporting the rear of the deck.

23. The exercise apparatus according to claim 1, further comprising means for raising and lowering at least one end of the frame to selectively incline the support platform means.

24. The exercise apparatus according to claim 23, wherein the means for raising and lowering the frame includes:

at least one longitudinally curved arm disposed lengthwise relative to the frame, the curved arm having a forward reaction end portion;

means for supporting the curved arm relative to the frame; and, means for longitudinally sliding the arm relative to the frame along the arc of the curved arm to extend and retract the forward reaction end portion of the arm relative to the frame.

25. The exercise apparatus according to claim 24, wherein the curved arm is concave in the downward direction.

26. The exercise apparatus according to claim 25, wherein the means for raising and lowering the frame includes power means to longitudinally slide the curved arm.

27. An exercise treadmill apparatus, comprising;

(a) a ground engaging frame;

(b) support platform means pivotally mounted on the frame to pivot about a pivot axis between a nominal position and a displaced position; and, (c) a suspension system for supporting the support platform means relative to the frame and permitting the support platform means to displace relative to the frame about the pivot axis of the support platform means under loads imparted on the support platform means during use of the apparatus, the suspension system comprising:

linear resistance means generating a level of resistance force in proportion to the speed at which the length of the linear resistance means is altered; and, first means for connecting the linear resistance means to the platform means to change the speed at which the length of the linear resistance means is altered as a function of the angular position of the support platform means about the pivot axis of the support platform means; wherein said first connecting means comprises at least one lever arm pivotally mounted on the frame to pivot about an axis; means for pivotally connecting the lever arm at a location spaced from the pivot axis of the lever arm with the support platform means at a location spaced from the pivot axis of the support platform means; and, means for connecting the linear resistance means to the lever arm at a location spaced from the pivot axis of the lever arm.

28. The exercise apparatus according to claim 27, wherein the linear resistance means includes means for substantially reducing the resistance force generated by the linear resistance means as the support platform means pivots about the pivot axis of the support platform means in the direction from its displaced position towards its nominal position.

29. The exercise apparatus according to claim 28, wherein the linear resistance means includes damping means for damping the movement of the support platform means as the support platform means pivots about the pivot axis of the support platform means from its nominal position towards its displaced position.

30. The exercise apparatus according to claim 27, wherein the linear resistance means includes damping means for damping the movement of the support platform means as the support platform means pivots about the pivot axis of the support platform means from its nominal position towards its displaced position.

31. The exercise apparatus according to claim 27, wherein the linear resistance means includes damping means for damping the movement of the support platform means as the support platform means pivots about the pivot axis of the support platform means from its nominal position towards its displaced position.

32. The exercise apparatus according to claim 27, wherein the first connecting means connecting the linear resistance means to the support platform means to increase the speed at which the length of the linear resistance means is altered as the support platform means pivots around the pivot axis of the support platform means from its nominal position towards its displaced position.

33. The exercise apparatus according to claim 27, further comprising biasing means applying a biasing force on the support platform means tending to bias the support platform means from its displaced position towards its nominal position.

34. The exercise apparatus according to claim 33, wherein the biasing means acts on the suspension system.

35. The exercise apparatus according to claim 34, wherein the biasing means acts on the first connecting means.

36. The exercise apparatus according to claim 33, further comprising means for selectively adjusting the magnitude of the biasing means.

37. The exercise apparatus according to claim 27, wherein the support platform means, comprises:

a deck;

an endless belt; and, means for mounting the endless belt on the deck to present a moving surface of the endless belt on the top of the deck.

38. An exercise apparatus according to claim 37, wherein the belt mounting means includes a drive roller assembly mounted in association with the deck and in driving engagement with the belt, the drive roller assembly comprises;

a rotationally powered axle;

an elongate roller mounted on the axle; and, antifriction mounting means for antifrictionally mounting the axle in association with the deck.

39. The exercise apparatus according to claim 38, wherein:

the elongate roller includes a hub having a tapered center bore;

the axle is tapered to match the taper of the roller hub; and, the drive roller assembly further comprising means for urging the drive axle longitudinally along the length of the drive axle relative to the roller hub to achieve a wedge fit therebetween.

40. The exercise apparatus according to claim 27, further comprising means for raising and lowering at least one end of frame to selectively incline the support platform means, the means for raising and lowering the frame, comprising:

at least one longitudinally curved arm disposed lengthwise relative to the length of the support platform means, the curved arm having a forward reaction end portion;

means for supporting the curved arm relative to the frame; and, means for longitudinally sliding the arm relative to the frame along the arc defined by the curved arm to extend and retract the forward reaction end portion of the arm relative to the frame.

41. The exercise apparatus according to claim 40, wherein the means for raising and lowering the frame includes power means to longitudinally slide the curved arm.

42. An exercise treadmill, comprising:

(a) a frame;

(b) deck means pivotally mounted on the frame about a pivot axis;

(c) endless belt means mounted on the deck means and presenting a moving surface riding over the top of the deck means; and, (d) a suspension system for supporting the deck means relative to the frame, the suspension system permitting the deck means to pivot to a displaced position about the pivot axis of the deck means under forces imposed on the deck means by the user and returning the deck means to its nominal position when the forces imposed by the user are removed from the deck means, the suspension system comprising:

(i) a lever arm pivotally mounted on the frame to pivot about a pivot axis;

(ii) means for pivotally interconnecting the deck means with the lever arm at a location spaced from the pivot axis of the lever arm;

(iii) first resistance means acting on the lever arm to resist the rotation of lever arm in a first rotational direction about the pivot axis of the lever arm corresponding to the rotation of the deck means about the pivot axis of the deck means in the direction from the nominal position of the deck means to the displaced position of the deck means, with the magnitude of the resistance force generated by the first resistance means related to the angular orientation of the rotating lever arm; and, (iv) second resistance means generating a biasing force tending to return the deck means to its nominal position from its displaced position.

43. The exercise treadmill according to claim 42, wherein the second resistance means acts on the deck means.

44. The exercise treadmill according to claim 42, wherein the second resistance means includes means for applying the biasing force on the lever arm.

45. The exercise treadmill according to claim 42, wherein the first resistance means includes means for generating a resistance force of a magnitude related to the speed of rotation of the rotating lever arm.

46. The exercise apparatus according to claim 42, wherein the first resistance means further comprising means for significantly reducing the resistance force applied to the rotational movement of the lever arm when the lever arm rotates about the pivot axis of the lever arm in a direction opposite to the first rotational direction of the lever arm.

47. The exercise treadmill according to claim 42, wherein the first resistance means includes damping means to dampen the rotational movement of the lever arm about the pivot axis of the lever arm in the first rotational direction of the lever arm, with the magnitude of the damping force generated by the damping means related to the angular orientation of the rotating lever arm.

48. The exercise treadmill according to claim 47, wherein the magnitude of the damping force generated by the first resistance means is also related to the rate of change of angular orientation of the rotating lever arm.

49. The exercise apparatus according to claim 42, further comprising second connection means for connecting the first resistance means to the lever arm at a location spaced from the pivot axis of the lever arm whereby as the lever arm pivots about its pivot axis in its first rotational direction, the effective distance separating the line of action of the first resistance means from the second pivot axis increases.

50. The exercise treadmill according to claim 49, wherein the first resistance means includes damping means connected to the lever arm to dampen the rotational movement of the lever arm in the first rotational direction about the pivot axis of the lever arm.

51. The exercise treadmill according to claim 42, wherein the first connection means includes link means having a first end portion pivotally connected to the lever arm at a location spaced from the pivot axis of the lever arm and a second end portion pivotally connected to the deck means at a location spaced from the pivot axis of the deck means.

52. The exercise treadmill according to claim 51, wherein the line of action of the link means shifts closer to the pivot axis of the lever arm as the lever arm rotates in the first rotational direction about its pivot axis.

53. The exercise apparatus according to claim 51, further comprising means for varying the location at which the second end portion of the link means is connected to the deck means thereby to alter the effective distance separating the line of action of the link means from the pivot axis of the link means.

54. The exercise treadmill according to claim 42, further comprising means for varying the nominal position of the lever arm.

55. The exercise treadmill according to claim 42, wherein the endless belt means comprising a drive roller assembly mounted in association with the deck means and an endless belt trained over the drive roller assembly, the drive roller assembly comprising an axle, a drive roller mounted on the axle, and means connected to the axle to transmit rotational torque to the axle.

56. The exercise treadmill according to claim 55, wherein:

the belt drive roller includes a hub having a tapered center portion;

the axle is tapered to match the taper of the drive roller hub; and, the drive roller further comprising means for longitudinally loading the axle relative to the drive roller hub to achieve a snug fit therebetween.

57. The exercise apparatus according to claim 42, further comprising means for raising and lowering at least one end of the frame to selectively incline the deck means, the raising and lowering means, comprising:

at least one longitudinally curved arm disposed lengthwise relative to the deck means, the curved arm having a forward reaction end;

means for supporting the curve to frame relative to the frame; and, means for longitudinally sliding the curved arm relative to the frame along the arc of the curved arm to extend and retract the forward reaction end of the curved arm relative to the frame.

* * * * *